US006472969B1

(12) United States Patent
Hanato

(10) Patent No.: US 6,472,969 B1
(45) Date of Patent: Oct. 29, 2002

(54) WIRE-WOUND COMMON-MODE CHOKE COIL

(75) Inventor: Yoshio Hanato, Sabao (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/484,195

(22) Filed: Jan. 18, 2000

(30) Foreign Application Priority Data

Jan. 18, 1999 (JP) ..... 11-008940

(51) Int. Cl.[7] ..... H01F 27/29

(52) U.S. Cl. ..... 336/192; 336/83; 336/200; 336/208

(58) Field of Search ..... 336/208, 198, 336/233, 221, 83, 192, 200, 65

(56) References Cited

U.S. PATENT DOCUMENTS 6,242,996 B1 * 6/2001 Sato et al. ..... 336/200

FOREIGN PATENT DOCUMENTS

| | | | |
|---|---|---|---|
| JP | 62-152413 | | 9/1987 |
| JP | 2-10704 | | 1/1990 |
| JP | 5-87913 | | 4/1993 |
| JP | 5-62022 | * | 8/1993 |
| JP | 10-116740 | | 5/1998 |

* cited by examiner

*Primary Examiner*—Elvin Enad
*Assistant Examiner*—Tuyen T. Nguyen
(74) *Attorney, Agent, or Firm*—Keating & Bennett, LLP

(57) ABSTRACT

A wire-wound common-mode choke coil includes a core member provided with a winding core, flanges disposed at both ends of the winding core, and legs for supporting the core member having grooves defined therein, the grooves being provided in each of the flanges. Bottom edges of the grooves are elevated from the periphery of the winding core by about 1.0 to about 1.5 times the diameter of a wire used to define windings provided on the winding core and protrusions are provided at both ends of the winding core. The flank of the protrusions gradually increase in height as they extend toward the flanges.

24 Claims, 7 Drawing Sheets

WIRE-WOUND COMMON-MODE CHOKE COIL

BACKGROUND OF THE INVENTION

1. Field of the invention

The present invention relates to a wire-wound common-mode choke coil used as a noise filter or other component for blocking common mode noise.

2. Description of the Related Art

In FIG. 8, a common-mode choke coil for blocking common-mode noise includes a first winding 22 connected between an input terminal electrode 1*a* and an output terminal electrode 2*a*, and a second winding 23 connected between an input terminal electrode 1*b* and an output terminal electrode 2*b*. The first winding 22 and the second winding 23 are bifilar-wound in the same direction on a core member 20 which is made of a magnetic material, such as a ferrite.

FIG. 9 is a bottom perspective view showing the core member 20 of a conventional common-mode choke coil, which includes a winding core 11 which is arranged to accommodate the windings 22 and 23 thereon, and includes square flanges 12 and 13 disposed at both ends of the winding core 11. Grooves 14 and 15 are formed in the flanges 12 and 13, respectively, and extend from a side of each flange toward the winding core 11. With the formation of the grooves 14 and 15, a pair of legs 12*a* and 12*b* and a pair of legs 13*a* and 13*b* are provided with the grooves 14 and 15, respectively, between each pair of legs, and the legs support the core member 20. Terminal electrodes 1*a*, 1*b*, 2*a*, and 2*b* are provided on the ends of the legs 12*a*, 12*b*, 13*a*, and 13*b*, respectively.

In FIG. 10 shows a conventional coil in which the first and second windings 22 and 23 are wound in a single layer on the winding core 11 of the core member 20. Ends 22*a* and 22*b* of the first winding 22 and ends 23*a* and 23*b* of the second winding 23 are electrically connected to the terminal electrodes 1*a* and 2*a* and the terminal electrodes 1*b* and 2*b*, respectively.

In the conventional wire-wound common-mode choke coil 10 in FIG. 10, a problem occurs in that the bottom edges of the grooves 14 and 15 formed in the flanges of the core member 20 are flush with the periphery of the winding core 11, and the vertical surfaces of the legs 12*a*, 12*b*, 13*a*, and 13*b* extend perpendicularly relative to the periphery of the winding core 11. Therefore, when a stress is applied to the legs 12*a*, 12*b*, 13*a*, and 13*b* during winding of the first and second windings 22 and 23 on the core member 20, the stress is concentrated to the lower parts of the legs 12*a*, 12*b*, 13*a*, and 13*b*, which extends from the periphery of the winding core 11, thereby breaking the legs 12*a*, 12*b*, 13*a*, or 13*b*.

The following is a description of an inspection by image analysis of the first and second windings 22 and 23 in a wound-state, in the common-mode choke coil 10. The first and second windings 22 and 23 are visible between two legs of the core member 20, for example, the legs 13*a* and 13*b*. When the windings are viewed along arrow A in FIG. 10, it is possible to determine whether the windings 22 and 23 are properly wound on the winding core 11 by analyzing the image obtained.

In the image analysis, only one layer of windings, for example, a layer of the first winding 22, is visible through the groove 15 between the legs 13*a* and 13*b* of the core member 20, as shown in FIG. 11, when the first and second windings 22 and 23 are properly wound on the winding core 11, as shown in FIG. 10. On the other hand, overlapped windings 22 and 23 are identified through the groove 15 between the legs 13*a* and 13*b*, as shown in FIG. 13, when the first and second windings 22 and 23 are improperly wound, as shown in FIG. 12. Therefore, the wound-state of the first and second windings 22 and 23 is detected by analyzing the image of the first and second windings 22 and 23 visible through the groove 15, and thus, it is determined whether the first and second windings 22 and 23 are properly arranged.

However, a problem in a conventional wire-wound common-mode choke coil is that the result of the detection of the wound-state of the first and second windings 22 and 23 visible through the groove 15 varies according to the color and the diameter of the wire, the overlapping position, the overlapped state, or other factors and characteristics of the windings 22 and 23. Therefore, the inspection of the wound-state via image analysis is difficult and not reliable in a conventional wire-wound common-mode choke coil.

SUMMARY OF THE INVENTION

To overcome the problems described above, preferred embodiments of the present invention provide a wire-wound common-mode choke coil in which a core member is provided with a sufficient mechanical-strength and is constructed such that a reliable inspection of the wound state of windings on the core member can be performed.

According to one preferred embodiment of the present invention, a wirewound common-mode choke coil preferably includes a core member having a winding core, flanges disposed at both ends of the winding core, a plurality of legs located at both ends of grooves provided at the flanges, and terminal electrodes, each of the terminal electrodes being provided at the end of each of the legs and connected to ends of a plurality of windings wound on the winding core. At least four terminal electrodes are provided in the wire-wound common-mode choke coil. Bottom surfaces of the grooves are spaced from the periphery of the winding core, and protrusions are provided at ends of the winding core. The flank of the protrusions are preferably gradually elevated toward the flanges.

The protrusions are preferably provided at the lower portions of the legs and protrude out from the winding core, and also at the bottom surfaces of the grooves, thereby improving the mechanical strength of the legs and alleviating stress concentration to the lower portions of the legs, protruding out from the winding core.

The mechanical strength of the legs may be greater and the stress concentration may be alleviated by arranging protrusions which protrude out from the periphery of the winding core which extends toward the legs, higher than the bottom surface of the grooves, thereby increasing the cross-sectional areas of the protrusions.

The determination as to whether the windings are properly arranged may be performed simply by determining whether or not the windings are visible through one of the grooves. The bottom surface of the grooves is elevated from the periphery of the winding core by about 1.0 to about 1.5 times the diameter of the wire of the windings. The windings are not visible through a groove when the windings are properly wound, and the windings are visible through the groove when the windings are improperly wound.

Other features, elements and advantages of the present invention will become more apparent from the detailed description of preferred embodiments of the present invention below with reference to the attached drawings.

DETAILED DESCRIPTION OF PREFERRED EMBODIMENTS

A wire-wound common-mode choke coil according to preferred embodiments of the present invention is described as follows, with reference to the accompanying drawings.

Figure 1:
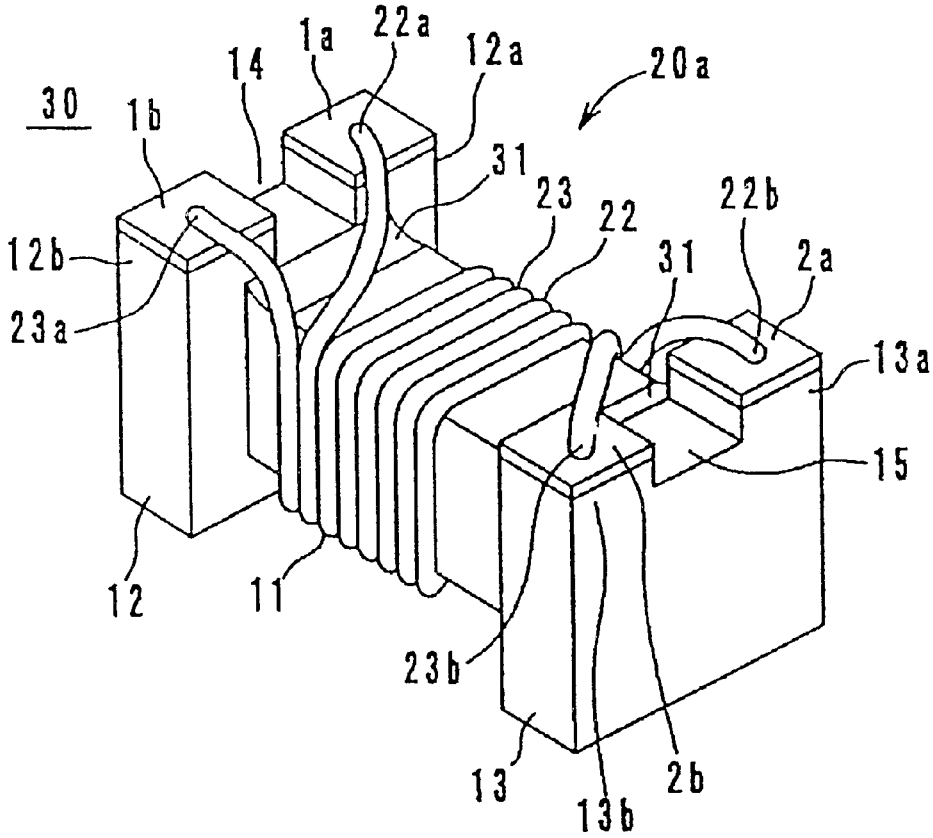
FIG. 1 is a perspective view showing a wire-wound common-mode choke coil according to a preferred embodiment of the present invention.
Figure 8:
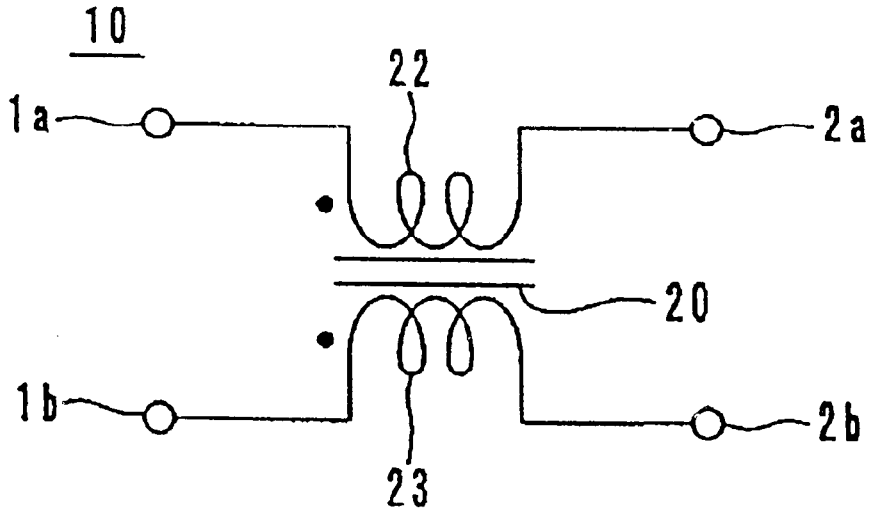
FIG. 8 is a block diagram of an electric circuit applied to a common-mode choke coil.
Figure 9:
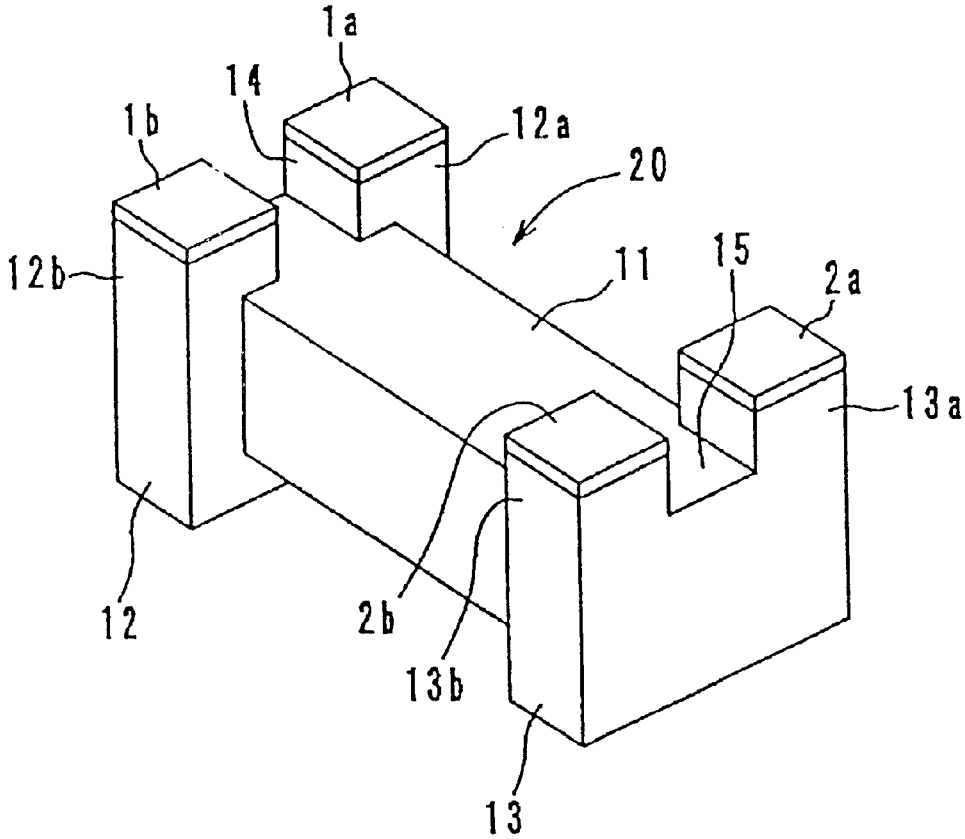
Fig. 9 PRIOR ART
FIG. 9 is a perspective view showing a core member of a known wire-wound common-mode choke coil.
Figure 10:
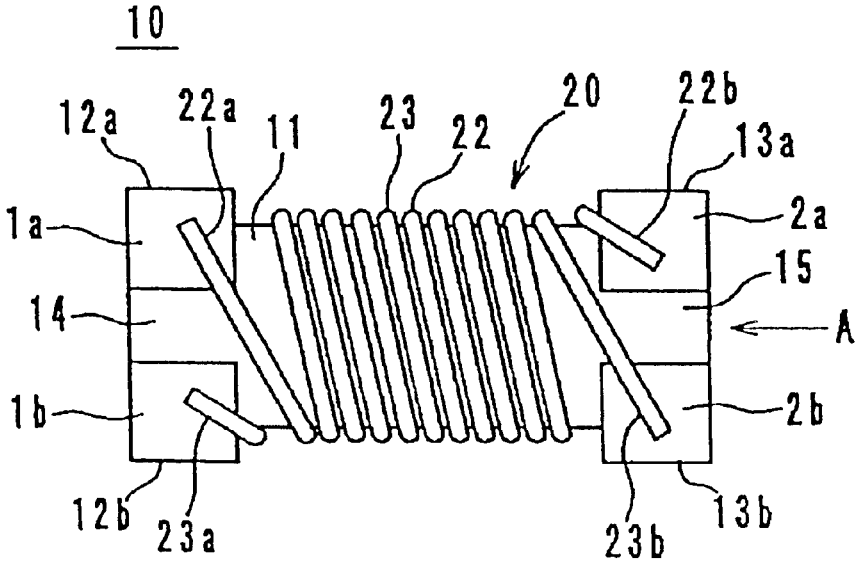
Fig. 10 PRIOR ART
FIG. 10 is a bottom view showing the core member shown in FIG. 9 having windings which are properly arranged.
Figure 11:
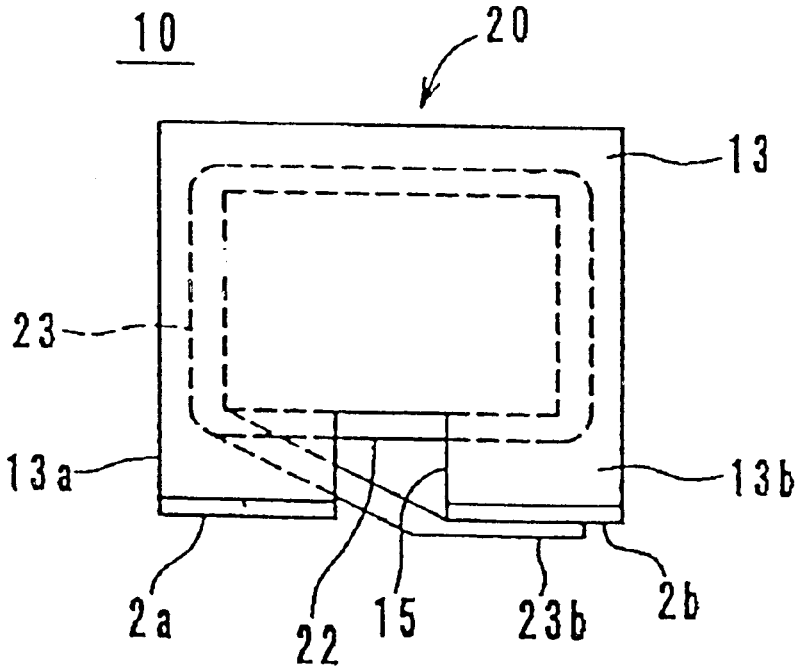
Fig. 11 PRIOR ART
FIG. 11 is a side view showing the core member shown in FIG. 10 provided with the windings.
Figure 12:
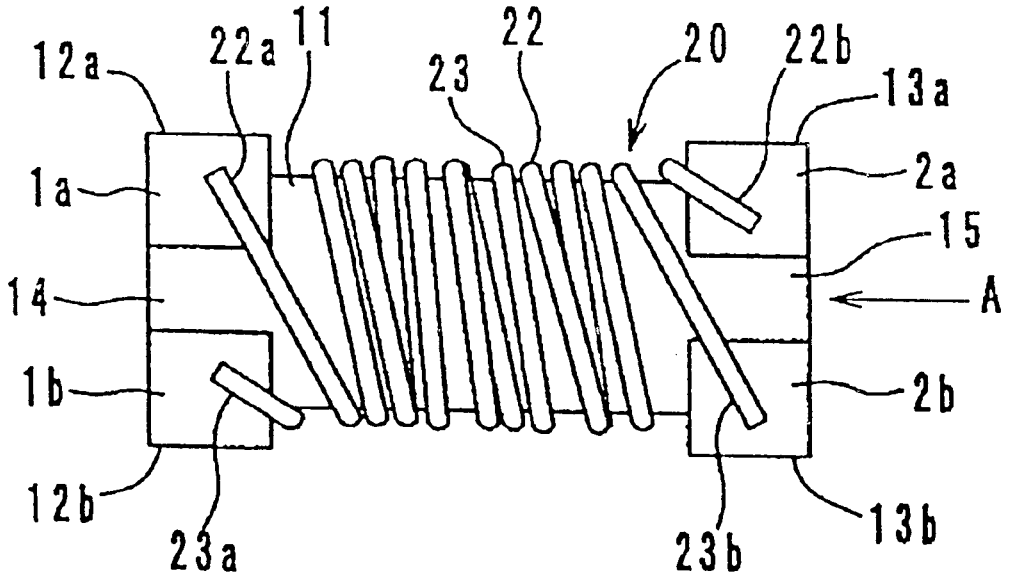
Fig. 12 PRIOR ART
FIG. 12 is a bottom view showing the core member shown in FIG. 9 having windings which are improperly arranged.
Figure 13:
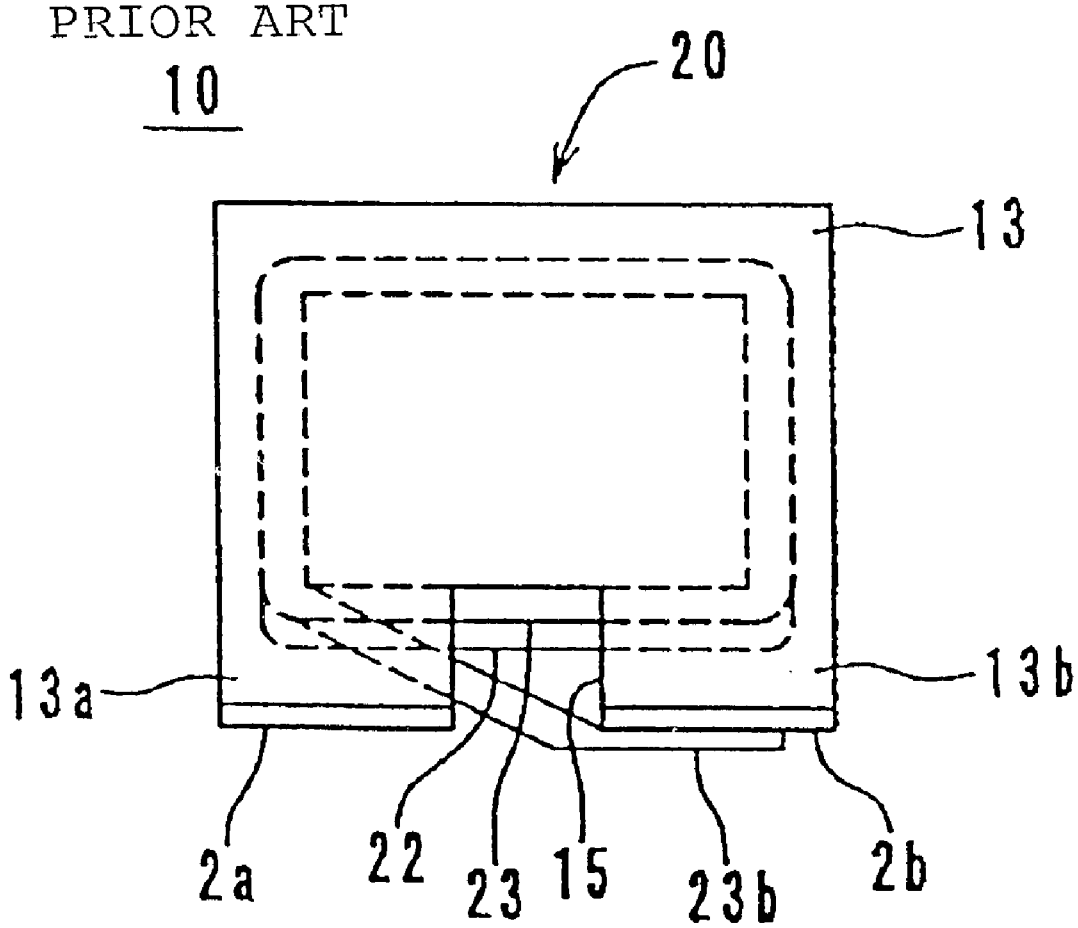
Fig. 13 PRIOR ART
FIG. 13 is a side view showing the core member shown in FIG. 12 provided with the windings.

FIG. 1 is a bottom perspective view showing a wire-wound common-mode choke coil according to a preferred embodiment of the present invention. A wire-wound common-mode choke coil 30 preferably includes a core member 20*a* as described below, in place of the core member 20 included in the wire-wound common-mode choke coil 10 shown in FIG. 8 through FIG. 10. A material of the core member 20*a* preferably includes a magnetic substance, such as a ferrite material, or an insulating material, such as alumina.

The core member 20*a* includes a winding core 11 to be provided with first and second windings 22 and 23 thereon, and flanges 12 and 13 which are preferably substantially square and provided at both ends of the winding core 11. The flanges 12 and 13 are provided with grooves 14 and 15, respectively, which are preferably arranged such that the grooves extend from an outer periphery of each flange toward the winding core 11. By forming the grooves 14 and 15, the core member 20*a* is provided with a pair of legs 12*a* and 12*b* and a pair of legs 13*a* and 13*b* defined by the grooves 14 and 15 between each pair of the legs 12*a* and 12*b*, and 13*a* and 13*b*. A pair of terminal electrodes 1*a* and 1*b* and a pair of terminal electrodes 2*a* and 2*b* are provided at the ends of the pair of legs 12*a* and 12*b* and the pair of legs 13*a* and 13*b*, respectively.

The winding core 11 of the core member 20*a* is provided with the first and second windings 22 and 23 in a single-layer winding. Wires, such as copper wires covered by an insulating material, such as a polyurethane resin, are used as the first and second windings 22 and 23. Copper wires are exposed at ends 22*a* and 22*b*, and at ends 23*a* and 23*b* of the first and second windings 22 and 23, which are electrically connected to the terminal electrodes 1*a* and 2*a*, and the terminal electrodes 1*b* and 2*b*, respectively, through soldering, thermal compression bonding, or other suitable processes.

Figure 2:
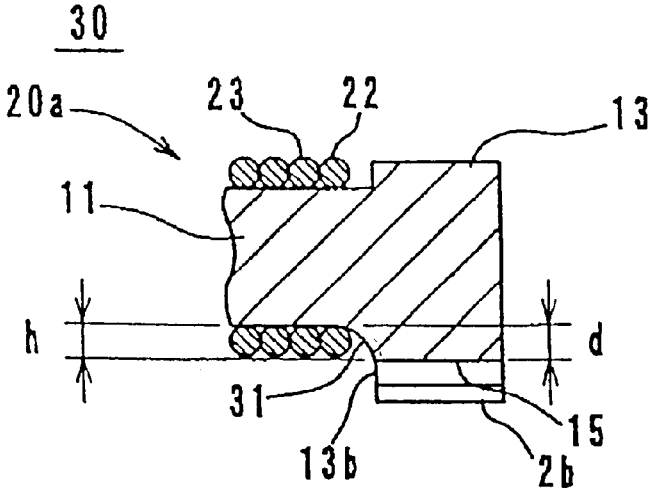
FIG. 2 is a partial sectional view showing the wire-wound common-mode choke coil shown in FIG. 1.

In FIG. 2, a step d is provided between bottom surfaces of the grooves 14 and 15 and the periphery of the winding core 11. The bottom surfaces of the grooves 14 and 15 are elevated from the periphery of the winding core 11. Protrusions 31 are provided at the ends of the winding core 11 so as to protrude from the periphery of the winding core. The height of the protrusions 31 gradually increases toward the flanges 12 and 13 with respect to the vertical dimension or height in cross section.

According to a preferred embodiment of the present invention, the protrusions 31 preferably include concave curved surfaces and the height h of the protrusions 31 is substantially equal to the height of the step d located between the bottom surfaces of the grooves and the periphery of the winding core.

With the arrangement in which the protrusions 31 are located at the ends of the winding core 11, the concave curved surfaces of the protrusions 31 gradually increase in height as they extend toward the flanges 12 and 13. The cross-sectional areas of lower portions of the legs 12*a* and 12*b*, and 13*a* and 13*b* extending from the winding core 11 are large enough for providing the legs 12*a* and 12*b*, and the legs 13*a* and 13*b* with greatly increased mechanical strength. The stress concentration at the lower portions of the legs 12*a* and 12*b* and the legs 13*a* and 13*b* extending from the winding core 11 is alleviated since the protrusions 31 are provided at the step extending from the periphery of the winding core 11 to the bottom edges of the grooves 14 and 15, as well as the protrusions extending from the winding core 11 to the protruding portions of the legs 12*a* and 12*b* and the legs 13*a*and 13*b*. With this arrangement, the legs 12*a* and 12*b* and the legs 13*a* and 13*b* are prevented from being broken by forces applied to the legs during installation and winding of the first and second windings 22 and 23 on the core member 20*a*.

Figure 3:
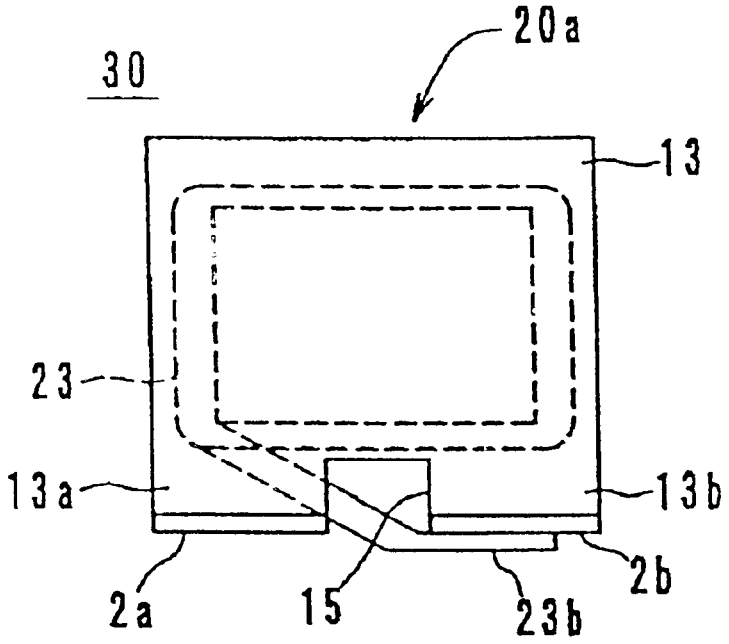
FIG. 3 is a side view showing the wire-wound common-mode choke coil shown in FIG. 1 having windings which are properly provided.
Figure 4:
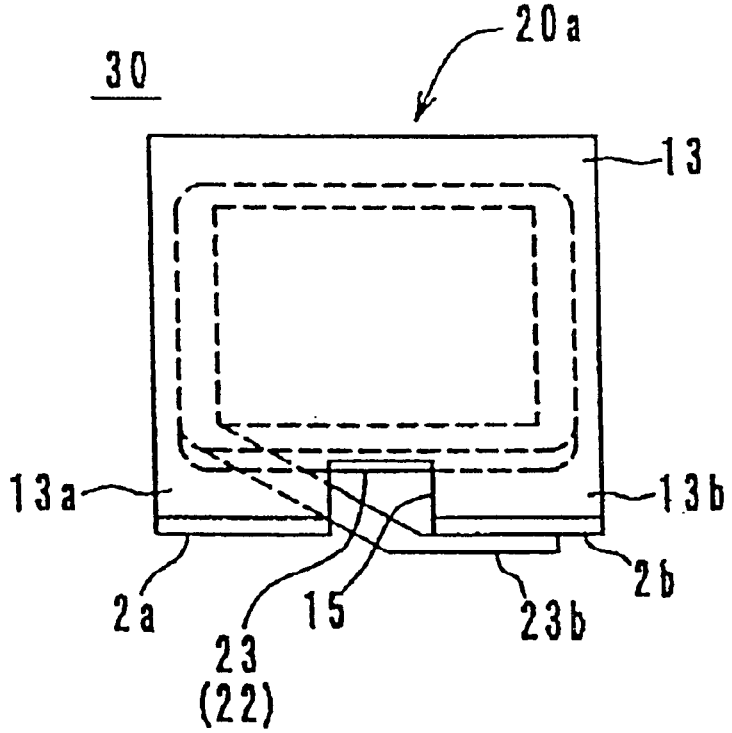
FIG. 4 is a side view showing the wire-wound common-mode choke coil shown in FIG. 1 having windings which are improperly wound.

A reliable image analysis inspection of the wound state of the first and second windings 22 and 23 can be performed if the height of the step d is within the range of about 1.0 to about 1.5 times the diameter of a wire used to define the first and second windings 22 and 23. FIG. 3 is a side view from an end of the core member 20*a*. When the first and second windings 22 and 23 are properly arranged in a single layer, the first and second windings 22 and 23 are invisible through the groove 15 since the first and second windings 22 and 23 are hidden by the step d between the bottom surface of the groove 15 and the periphery of the winding core 11. FIG. 4 is a side view of the same. The first and second windings 22 and 23 which are improperly arranged are visible through the groove 15.

Therefore, the inspection of the wound state of the first and second windings 22 and 23 is performed by determining whether the first or second winding 22 or 23 is visible through a groove 14 or 15. Such an alternative determination eases the image analysis inspection of the wound state of the first and second windings 22 and 23, thereby providing a reliable inspection result. The height of the step d is preferably within the range of about 1.0 to about 1.5 times the diameter of the wire used to define the first and second windings 22 and 23, because the height of overlapped windings 22 and 23 is, in most cases, about 1.5 to about 2.0 times the diameter of a wire.

The present invention is not limited to preferred embodiments as described above. The preferred embodiments described above may be modified within the spirit and scope of the present invention.

Figure 5:
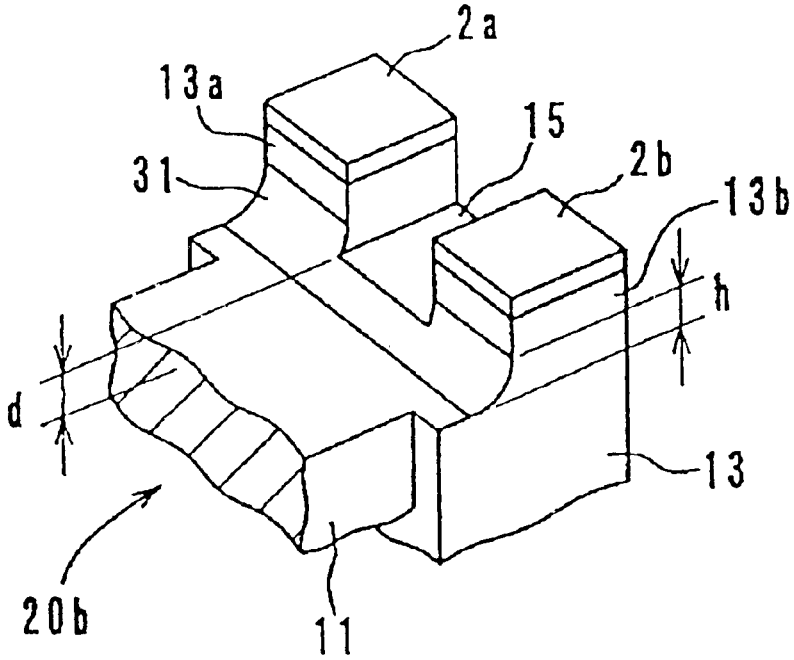
FIG. 5 is a partial perspective view showing a core member of the wire-wound common-mode choke coil according to another preferred embodiment of the present invention.

For example, the height h of the protrusions 31 may be smaller than the height of the step d of the bottom edges of the grooves 14 and 15. In contrast, the height h of the protrusion 31 may be greater than the height of the step d, as in a core member 20*b* shown in FIG. 5. The greater protrusion 31 provides a greater cross-sectional area thereof, which mechanically strengthens the legs 13*a* and 13*b* and alleviates stress concentration thereto. The protrusion 31 in FIG. 5 is arranged to extend in a width direction of the core member 20*b* at the outstanding portion of the flange 13. The width of the winding core 11 is smaller than that of the flange 13, in FIG. 5. The width of the winding core 11 may be the same as that of the flange 13. The arrangement described above in conjunction with FIG. 5 is applied to the other end of the core member 20*b*, which is not shown in FIG. 5, for obtaining the same effect.

Figure 6:
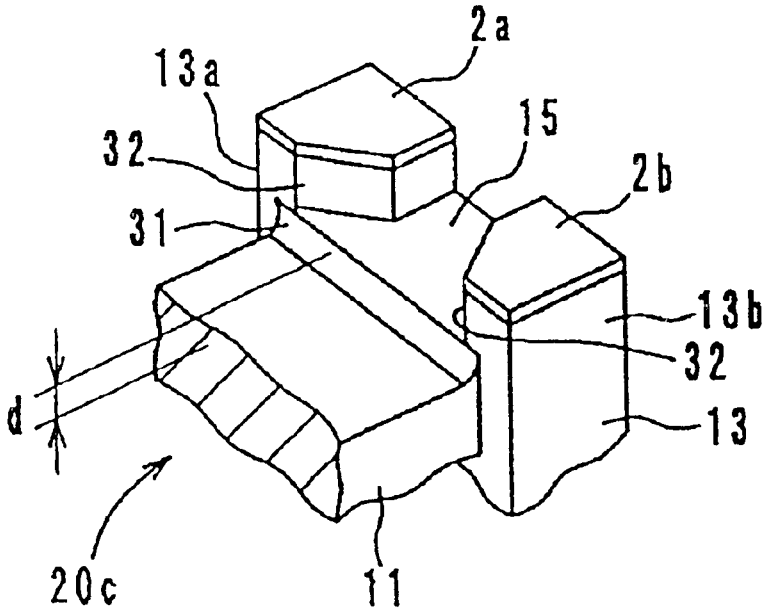
FIG. 6 is a partial perspective view showing a core member of the wire-wound common-mode choke coil according to a further preferred embodiment of the present invention.

As in a core member 20*c* shown in FIG. 6, beveled corners 32 may be provided on the legs 13*a* and 13*b*, by eliminating the corners adjacent the winding core 11. With this arrangement, the ends of the first and second windings 22 and 23 can be led to the terminal electrodes 2*a* and 2*b* without interference of the corners of the legs 13*a* and 13*b*, thereby reducing the possibility of the ends of the first and second windings 22 and 23 being caught by the legs 13*a*and 13*b*, and reducing the stress on the legs 13*a* and 13*b*. The arrangement described above in conjunction with FIG. 6 is applied to the other end of the core member 20*c*, which is not shown in FIG. 6, for obtaining the same effect.

Figure 7:
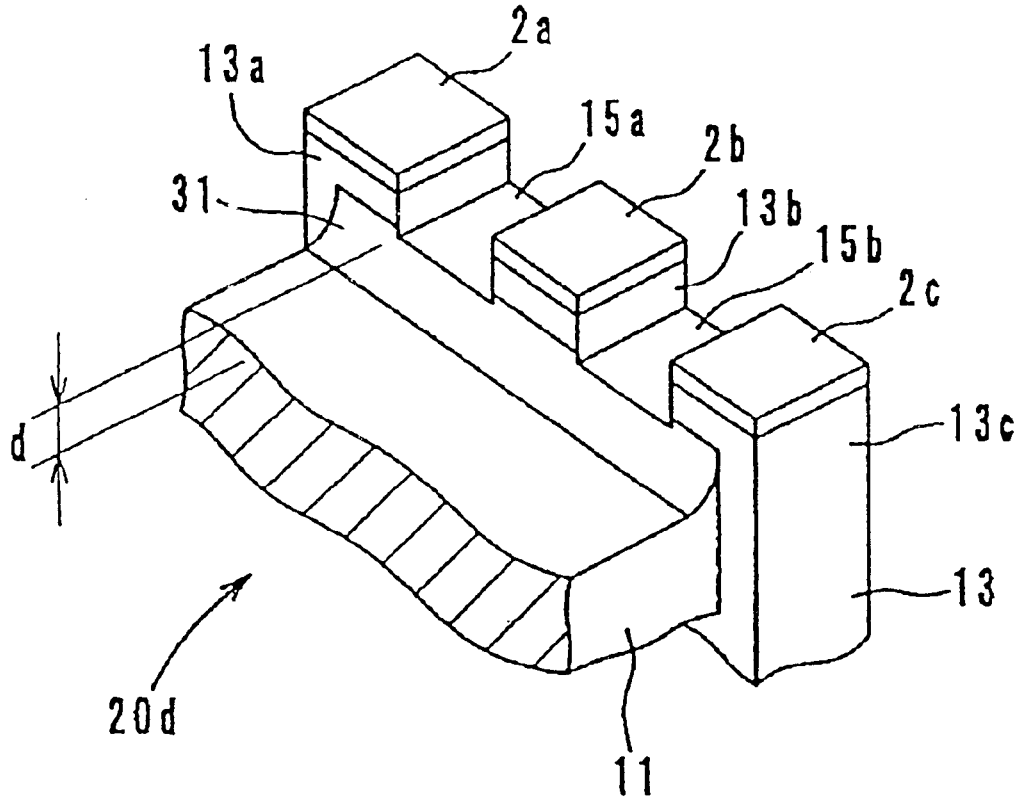
FIG. 7 is a partial perspective view showing a core member of the wire-wound common-mode choke coil according to a still further preferred embodiment of the present invention.

According to a preferred embodiment of the present invention described above, a bifilar-wound coil preferably includes at least two windings 22 and 23. The above-described arrangement may be applied to a trifilar-wound coil having three windings, and to a coil having four or more windings. FIG. 7 is a perspective view showing a critical portion of a core member 20*d* of a trifilar-wound common-mode choke coil. The core member 20*d* is provided with grooves 15*a* and 15*b* in a flange 13, and legs 13*a*, 13*b*, and 13*c* defined thereby. The bottom edges of the grooves 15*a* and 15*b* are elevated by a height of the step d from the periphery of a winding core 11. A protrusion 31 is arranged to extend from the periphery of the winding core 11 to the bottom edges of the grooves 15*a* and 15*b*. The flank surfaces of the protrusions 31 shown in FIGS. 1 and 2, and in FIGS. 5 to 7 may be planar, instead of being curved.

According to the present invention, as described above in preferred embodiments thereof, the mechanical strength of the legs is improved and stress concentration applied to the lower portions of the legs extending from the winding core is alleviated since the step is provided between the bottom surfaces of the grooves formed in the flanges and the periphery of the winding core, and the protrusions which gradually increase in height toward the flanges with respect to the dimension of height in cross section are provided at the ends of the winding core. The protrusions are provided not only with the extending portion of leg from the winding core but also with the step between the bottom surface of the groove and the periphery of the winding core.

The mechanical strength of the legs may be further increased and the stress concentration to the legs may be further alleviated by arranging the protrusions to extend toward the legs, higher than the bottom edges of the grooves, to increase the cross-sectional areas of the protrusions.

A reliable result is obtained from an inspection of the wound state of the windings by image analysis, the inspection being facilitated by determining whether the windings are visible through a groove formed in a flange, since the height of the step of the bottom edges of the grooves elevated from the periphery of the winding core is within the range of about 1.0 to about 1.5 times the diameter of a wire included in the windings. The windings are not visible through a groove when the windings are properly arranged, while the windings are visible through the groove when the windings are improperly arranged.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A wire-wound common-mode choke coil, comprising:

a core member having a winding core and a plurality of windings disposed thereon;

flanges disposed at both ends of said winding core and including grooves defined therein;

a plurality of legs located at both ends of the grooves in the flanges; and a plurality of terminal electrodes, one of the plurality of terminal electrodes being located at an end of each of the legs and connected with an end of the plurality of windings provided on said winding core;

wherein bottom edges of said grooves are arranged to increase in height from a periphery of said winding core, and protrusions are provided at both ends of said winding core, and a flank of said protrusions being arranged to gradually increase in height toward said flanges.

2. A wire-wound common-mode choke coil according to claim 1, wherein said protrusions extend from the periphery of said winding core toward said legs and are higher than the bottom edges of said grooves.

3. A wire-wound common-mode choke coil according to claim 1, wherein the bottom edges of said grooves are elevated from the periphery of said winding core by about 1.0 to about 1.5 times the diameter of a wire of the plurality of windings.

4. A wire-wound common-mode choke coil according to claim 1, wherein the core member is made of a magnetic material.

5. A wire-wound common-mode choke coil according to claim 1, wherein the core member is made of an insulating material.

6. A wire-wound common-mode choke coil according to claim 1, wherein the plurality of windings include first and second windings.

7. A wire-wound common-mode choke coil according to claim 1, wherein the flanges are substantially square.

8. A wire-wound common-mode choke coil according to claim 1, wherein the plurality of windings include first and second windings arranged in a single-layer winding configuration on the winding core of the core member.

9. A wire-wound common-mode choke coil according to claim 1, wherein a step is provided between bottom surfaces of the grooves and the periphery of the winding core.

10. A wire-wound common-mode choke coil according to claim 1, wherein the plurality of terminal electrodes comprises four terminal electrodes.

11. A wire-wound common-mode choke coil according to claim 10, wherein a step is provided between bottom surfaces of the grooves and the periphery of the winding core, and the protrusions include concave curved surfaces and the height of the protrusions is substantially equal to the height of the step located between the bottom surfaces of the grooves and the periphery of the winding core.

12. A wire-wound common-mode choke coil according to claim 11, wherein the concave curved surfaces of the protrusions gradually increase in height as they extend toward the flanges.

13. A wire-wound common-mode choke coil according to claim 1, wherein the groove are arranged such that when the windings are not properly arranged, the windings are visible through at least one of the grooves when viewed in a longitudinal direction of the core member and when the windings are properly arranged, the windings are not visible through one of the grooves when viewed in a longitudinal direction of the core member, wherein the windings are properly arranged when no portion of the windings overlaps any other portion of the windings, and the windings are not properly arranged when at least one portion of the windings overlaps another portion of the windings.

14. A wire-wound common-mode choke coil, comprising:

a core member having a winding core and a plurality of windings disposed thereon;

flanges disposed at both ends of said winding core and including grooves defined therein;

a plurality of legs located at both ends of the grooves in the flanges; and a plurality of terminal electrodes, one of the at least four terminal electrodes being located at an end of the legs and connected with an end of the plurality of windings provided on said winding core;

wherein the grooves are arranged such that when the windings are not properly arranged, the windings are visible through at least one of the grooves when viewed in a longitudinal direction of the core member and when the windings are properly arranged, the windings are not visible through one of the grooves when viewed in a longitudinal direction of the core member, wherein the windings are properly arranged when no portion of the windings overlaps any other portion of the windings, and the windings are not properly arranged when at least one portion of the windings overlaps another portion of the windings; and bottom edges of said grooves are elevated from the periphery of said winding core by about 1.0 to about 1.5 times the diameter of the plurality of windings.

15. A wire-wound common-mode choke coil according to claim 14, wherein protrusions are provided at both ends of said winding core, the flank of said protrusions being arranged to gradually increase in height toward said flanges.

16. A wire-wound common-mode choke coil according to 15, wherein said protrusions extend from the periphery of said winding core toward said legs and are higher than bottom edges of said grooves.

17. A wire-wound common-mode choke coil according to claim 14, wherein the flanges are substantially square.

18. A wire-wound common-mode choke coil according to claim 14, wherein the plurality of windings include first and second windings arranged in a single-layer winding configuration on the winding core of the core member.

19. A wire-wound common-mode choke coil according to claim 14, wherein a step is provided between bottom surfaces of the grooves and the periphery of the winding core.

20. A wire-wound common-mode choke coil, comprising:

a core member having a winding core and a plurality of windings disposed thereon;

flanges disposed at both ends of said winding core and including grooves defined therein;

a plurality of legs located at both ends of the grooves in the flanges, the plurality of legs including beveled corner surfaces provided thereon; and a plurality of terminal electrodes, one of the plurality of terminal electrodes being located at an end of each of the legs and connected with an end of the plurality of windings provided on said winding core;

wherein bottom edges of said grooves are arranged to increase in height from a periphery of said winding core, and protrusions are provided at both ends of said winding core, and a flank of said protrusions being arranged to gradually increase in height toward said flanges.

21. A wire-wound common-mode choke coil according to claim 20, wherein a pair of the beveled corner surfaces are provided at both ends of said winding core, each pair of beveled corner surfaces being arranged to face each other.

22. A wire-wound common-mode choke coil according to claim 21, wherein each pair of the beveled corner surfaces are separated by one of the grooves.

23. A wire-wound common-mode choke coil according to claim 20, wherein said protrusions extend from the periphery of said winding core toward said legs and are higher than the bottom edges of said grooves.

24. A wire-wound common-mode choke coil according to claim 20, wherein the bottom edges of said grooves are elevated from the periphery of said winding core by about 1.0 to about 1.5 times the diameter of a wire of the plurality of windings.

* * * * *